United States Patent [19]

Suchy

[11] Patent Number: 4,664,457

[45] Date of Patent: May 12, 1987

[54] OUTLET ASSEMBLY FOR BUILT IN VACUUM SYSTEMS

[76] Inventor: Leonard J. Suchy, 4134 SW. 322nd, Federal Way, Wash. 98032

[21] Appl. No.: 817,010

[22] Filed: Jan. 8, 1986

[51] Int. Cl.[4] ..... H01R 13/74

[52] U.S. Cl. ..... 339/15; 339/44 R; 339/122 R

[58] Field of Search ..... 339/15, 122 R, 122 F, 339/123, 44 R, 44 M; 174/47; 200/61.6; 15/314

[56] References Cited

U.S. PATENT DOCUMENTS

| | | | |
|---|---|---|---|
| 3,076,068 | 1/1963 | Racklyeft | 339/15 |
| 3,258,553 | 6/1966 | Breslin | 15/314 |
| 3,283,093 | 11/1966 | Bishop | 200/61.6 |
| 3,291,927 | 12/1966 | Riley, Jr. et al. | 15/314 |
| 3,465,111 | 9/1969 | Breslin | 339/16 R |
| 3,483,503 | 12/1969 | Paradiso | 339/15 |
| 4,211,457 | 7/1980 | Meadows | 339/15 |
| 4,336,427 | 6/1982 | Lindsay | 339/15 |
| 4,451,108 | 5/1984 | Skidmore | 339/123 |
| 4,473,923 | 10/1984 | Neroni et al. | 339/15 |

FOREIGN PATENT DOCUMENTS

| | | |
|---|---|---|
| 670879 | 9/1963 | Canada . |
| 930150 | 7/1973 | Canada . |

*Primary Examiner*—John McQuade

*Attorney, Agent, or Firm*—Roy E. Mattern, Jr.

[57] ABSTRACT

In dwellings, a wall or floor outlet assembly is installed to receive vacuum hoses and conduits of built in vacuum cleaning systems and their low voltage power components, and also to receive high voltage electrical power cords and circuits, such as those connected to rug beater rotating bristled bars operated during vacuuming operations, or such as those connected to lamps. The assembly includes: a mounting bracket having an electrical box with a receiving chamber to receive a duplex 110 to 115 volt electrical receptacle, an integral adjacent receiving and mounting plate with respective fitting holes to receive portions of a vacuum conduit, an optional rubber sealing gasket, an optional low voltage indicating light, a low voltage switch, and other related low voltage circuitry, with the low voltage switch often being activated upon insertion of the end of the portable vacuum hose, and integral portions to receive fasteners used to secure this mounting bracket to the structure of a dwelling; a combined frame and spring retracted cover for attachment to the mounting bracket to cover and/or seal portions of the connectors of the various components to be secured to the receiving and mounting plate, and to provide an overall decorative full cover; and an optional plaster guard to keep this outlet assembly clean during construction work.

6 Claims, 8 Drawing Figures

OUTLET ASSEMBLY FOR BUILT IN VACUUM SYSTEMS

BACKGROUND

For many years built in vacuum syustems for homes and/or components thereof have been provided by several manufacturers. Also some of them are installed, so when an operator enters an end of the portable vacuum hose to a wall or floor outlet, a switch is moved, completing a low voltage control circuit. Upon such closing of a low voltage control circuit, such as a ≧volt circuit, a higher voltage circuit, generally 110 to 115 volts in the U.S.A., is thereby remotely turned on to start the central vacuum power unit, and soon the operator is vacuuming a selected area. Or the operator may be using a vacuum system where a low voltage switch is available at or nearby the end of the portable vacuum base.

If the operator decides the power of the suction is not enough to loosen the dirt or debris, he or she may operate another unit to loosen such dirt. In general these additional cleaning units are referred to as rotating brushes or beater bars. To be effective their electric motors should be supplied by electrical power having a higher voltage, such as 110 to 115 volts. So the lower voltage power of 24 volts available at the wall vacuum outlet is not to be used. Most often a 110 volt outlet is not generally conveniently located near the wall vacuum outlet. This generally necessitates the use of an extension cord to transmit the 110 to 115 volt electrical power from the conventional electrical outlet to the 110 to 115 volt electrical power cord associated with the electrical motor which drives the rotating cleaning brushes or beater bars.

Although many manufacturers and earlier inventors have provided low voltage circuits and their controls throughout a built in vacuum system, as illustrated, for example, in U.S. Patents such as:

Mr. Breslin's U.S. Pat. No. 3,258,553 entitled "Electrical Connector for Wires Subject to Flexing";

Mr. Breslin's U.S. Pat. No. 3,465,111 entitled "Apparatus for Establishing a Combined Fluid Conduit and Electrical Circuit Ssytem";

Mr. Meadows' U.S. Pat. No. 4,211,457 entitled "Vacuum Cleaning Apparatus";

Mr. Lindsay's U.S. Pat. No. 4,336,427 entitled "Outlet Assembly for a Vacuum Cleaning System"; and Messrs. Neroni and Byers' U.S. Pat. No. 4,473,923 entitled "Vacuum Cleaning Tool Adapter with Electrical Control Means", none of these inventors, and no available products on the market are known to present a wall or floor outlet assembly for receiving both built in vacuum cleaning hoses and their low voltage power components, and high voltage electrical power receptacles for plugging in higher voltage electrical cords.

SUMMARY

To conveniently construct a dwelling which is to include a central built in vacuum system having 24 volt control circuitry, and thereafter to conveniently operate cleaning equipment, which includes electrically driven rotating brushes or beater bars requiring higher voltage electrical power, a wall or floor outlet assembly is provided initially for the builders and installers and then subsequently for those persons living and/or working in the dwelling, who must undertake cleaning operations. This wall or floor outlet assembly is provied to receive standard 110 to 115 volt electrical wiring and outlet receptacles, and substantially all presently manufactured components of central built in vacuum systems, inclusive of their 24 volt control circuitry.

The primary component of this wall or floor outlet assembly, which preferably is used by electrical building contractors, is a mounting bracket preferably integrally including: a fire safe electrical box with a receiving chamber to subsequently receive a duplex 110 to 115 volt electrical receptacle, to later on in turn receive the plug in ends of 110 to 115 volt electrical cords; an integral adjacent receiving and mounting plate with respective fitting holes or knock outs, to receive portions of a vacuum conduit, an optional rubber sealing gasket, an optional low voltage indicating light, a low voltage switch and/or connection, and other possible related low voltage circuitry and components, often with the low voltage switch being activated upon the insertion of the end of the portable vacuum hose; and integral portions to receive fasteners used to secure this mounting bracket to studs or other portions of a structure serving as a dwelling. Also during the construction of a dwelling, after this mounting bracket is installed, one of the building contractors places an optional plaster guard to initially and temporarily fit over both the fire safe electrical box receiving chamber, and the adjacent receiving and mounting plate to keep them celan during follow on construction operations, such as drywall installations, inclusive of related spackling and plastering.

After such installation of the mounting bracket and its protection, the optional plaster guard is removed, and various standard vacuum and electrical components are connected. Thereafter a combined frame and spring retracted cover is attached to the mounting bracket. This cover remains to cover and/or to seal portions of the various standard vacuum and electrical components, and to provide an overall decorative full cover.

Optionally, during manufacture of this wall or floor outlet assembly some of these standard vacuum and electrical components are preassembled with respect to their mounting on the mounting bracket. They are also arranged to be protected by the plaster guard, which is temporarily used during construction of the dwelling.

As finally assembled and ready for the occupants of the dwelling, who will be concerned with the subsequent and repeated cleaning operations, this wall or floor outlet assembly provides the one stop convenient locaion of all the necessary components of a built in vacuum system with the 24 volt control circuitry, coupled with 110 to 115 volt power or lighting circuitry. Oftentimes between cleaning operations, the 110 to 115 volt receptacles will be utilized for lighting and other purposes. Such receptacles in many dwellings will then be available in hallways where vacuum outlets are often installed, and previously no 110 to 115 volt receptacles have been conveniently provided in such hallways.

DRAWINGS

A preferred embodiment of the wall or floor outlet assembly is illustrated in the drawings wherein:

FIG. 1 is a perspective view showing a person using a 110 to 115 volt electrically powered rotary brush or beater bar operating in the surrounding presence of the vauum created by the built in vacuum system, indicating the insertion of the vacuum hose which triggers the 24 volt control circuitry, in turn triggering the 110 to 115 volt circuitry supplying power to the central vacuum system motor, not shown, and also indicating how the power cord of 110 to 115 volt electrical powered rotary brush is conveniently plugged into the receptable mounted within the receiving chamber of the integral electrical box of the mounting bracket of this wall or floor outlet assembly;

DESCRIPTION OF THE PREFERRED EMBODIMENT

Figure 2:
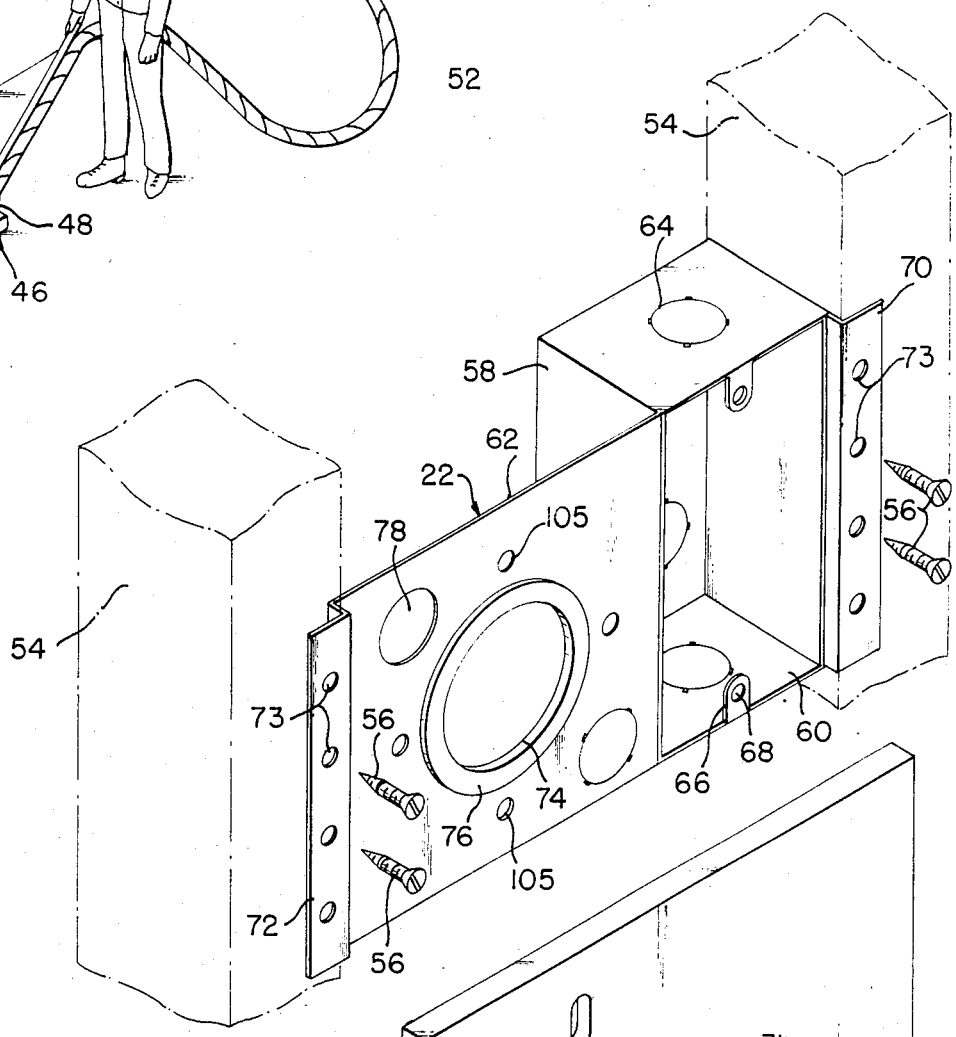
FIG. 2 is a perspective view of the integral mounting bracket of this wall or floor outlet assembly, with phantom lines indicating a stud of a dwelling structure.
Figure 3:
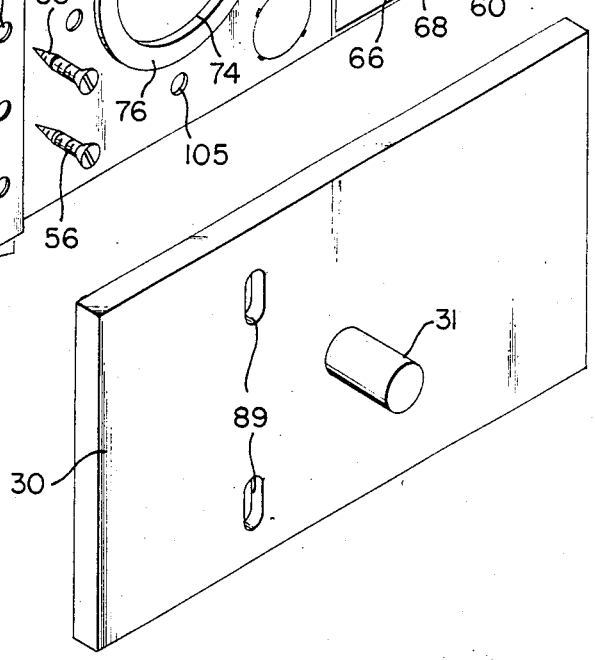
FIG. 3 is a perspective view of the plaster guard preferably placed over the integral mounting bracket during the construction time of a dwelling when the drywalls and/or plaster walls are being installed and finished.
Figure 4:
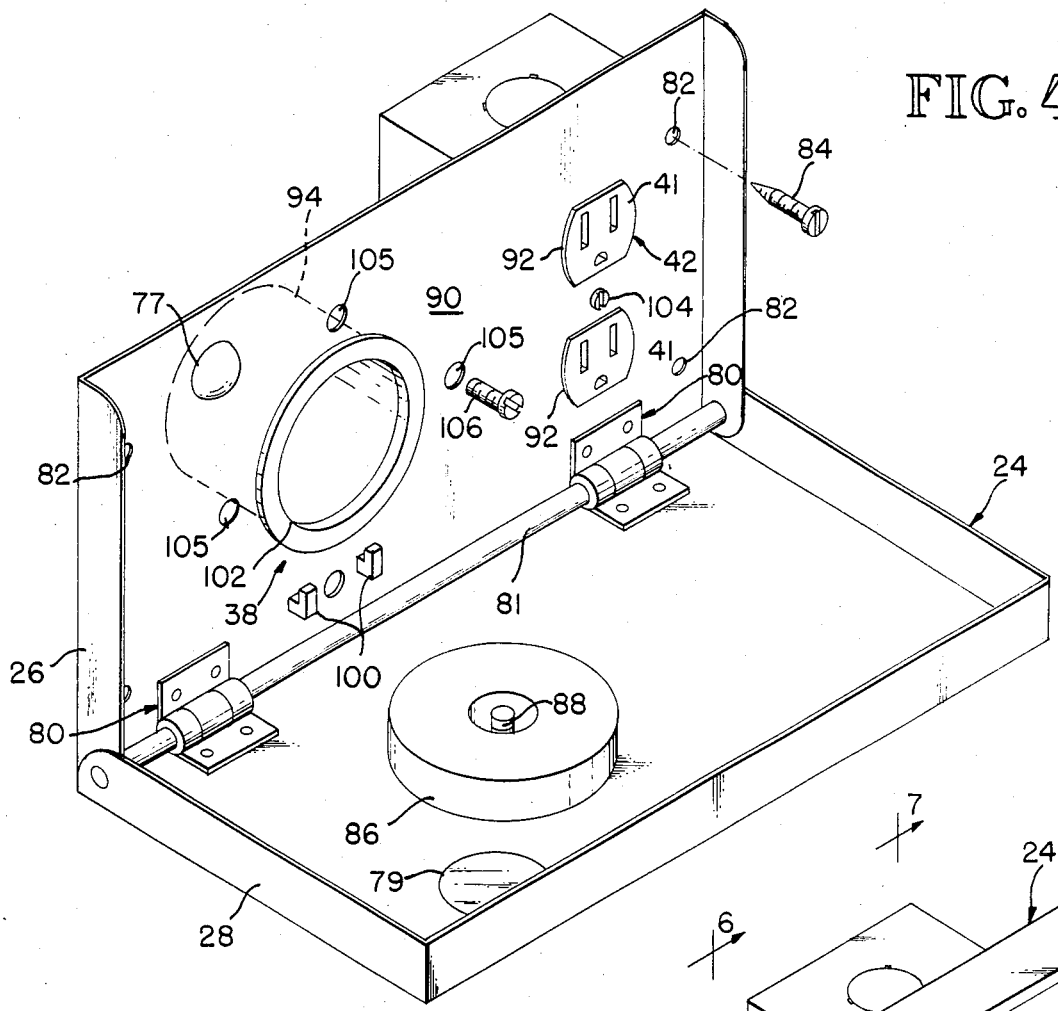
FIG. 4 is a perspective view of the combined frame and spring retracted cover attached to the integral mounting bracket, after the installation of the various components of the built in vacuum system, the 24 volt circuitry components and the 110 to 115 volt circuitry components.
Figure 5:
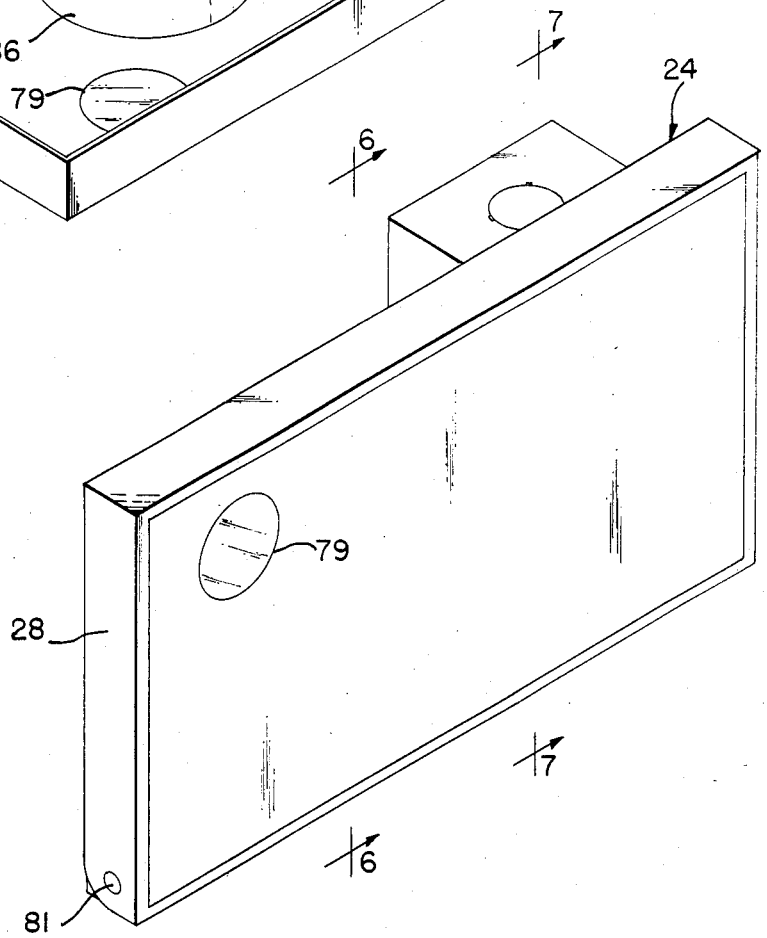
FIG. 5 is a perspective view of the exterior of the closed combined frame and spring retracted cover.

The preferred embodiment of the wall or floor outlet assembly 20 is shown in the drawings, with FIGS. 2 and 4 illustrating the basic components of the mounting bracket 22, and the combination 24 of the frame 26 and spring retracted cover 28, which are supplied to customers by a manufacturer. FIG. 3 shows an optional plastic guard 30 with handle 31 used during construction of a dwelling.

Figure 8:
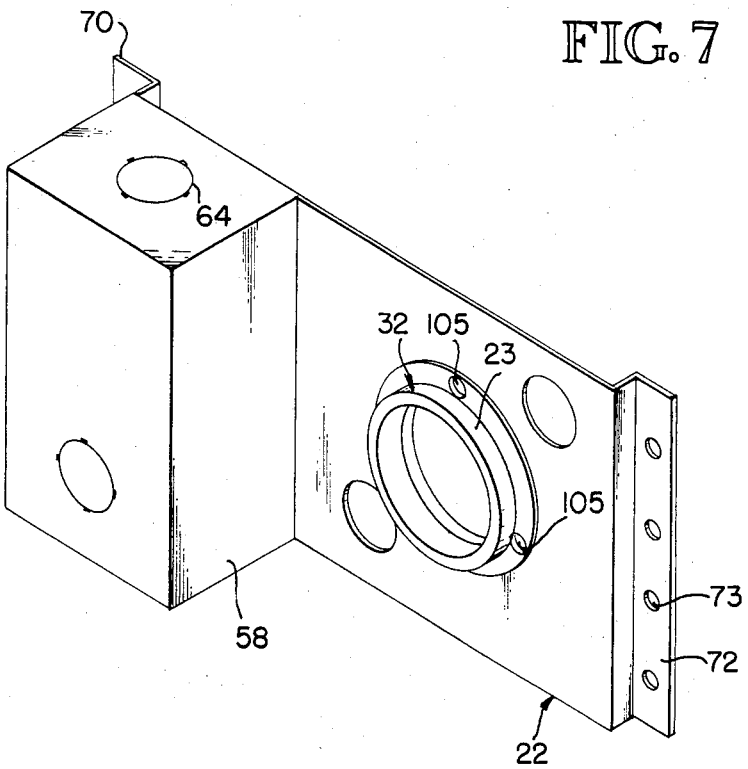
FIG. 8 is perspective view of the rear of the wall or floor outlet assembly showing the attachment adapter to receive the PVC tubing of the vacuum system.

FIG. 8 illustrates where the PVC tubing of the overall vacuum conduits 98 are secured to the attachment adapter 23.

Figure 6:
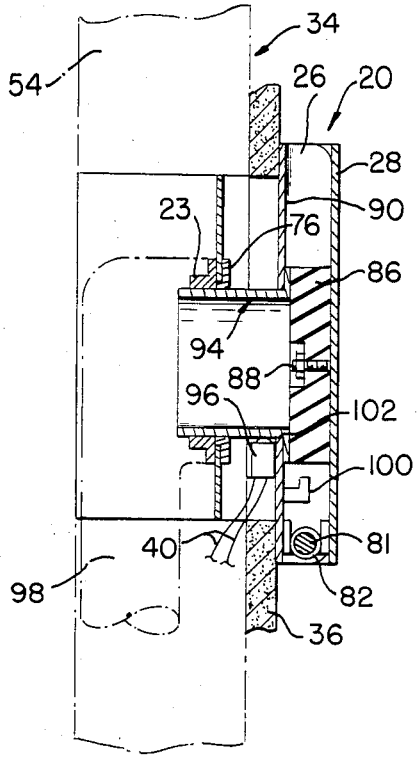
FIG. 6 is a cross section taken in reference to line 6—6 in FIG. 5, to illustrate how this wall or floor outlet assembly is installed and receives various components of the built in vacuum system and the 24 volt circuitry.
Figure 7:
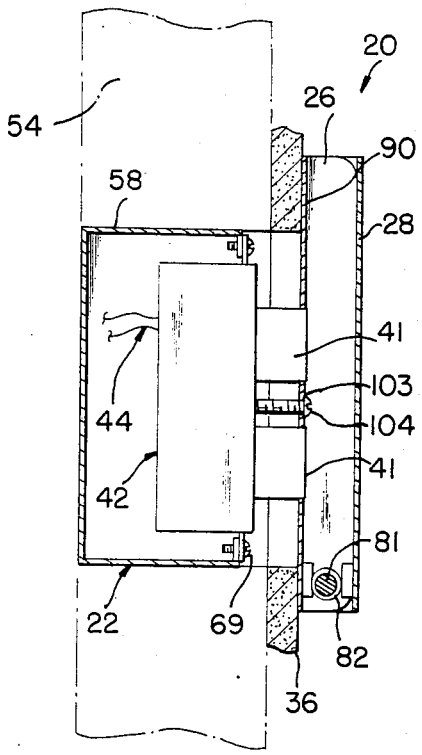
FIG. 7 is a cross section taken in reference to line 7—7 in FIG. 5, to illustrate how this wall or floor outlet assembly is installed and receives various components of the 110 to 115 volt circuitry.

FIGS. 6 and 7 illustrate the various components generally used at all times during operation of a built in vacuum system 32 of a dwelling 34. Some of these components are optionally installed by the manufacturer and/or supplier of the wall or floor outlet assembly 20, to the respective customers in accordance with their orders or the manufacturers or suppliers' list of selected available models.

Figure 1:
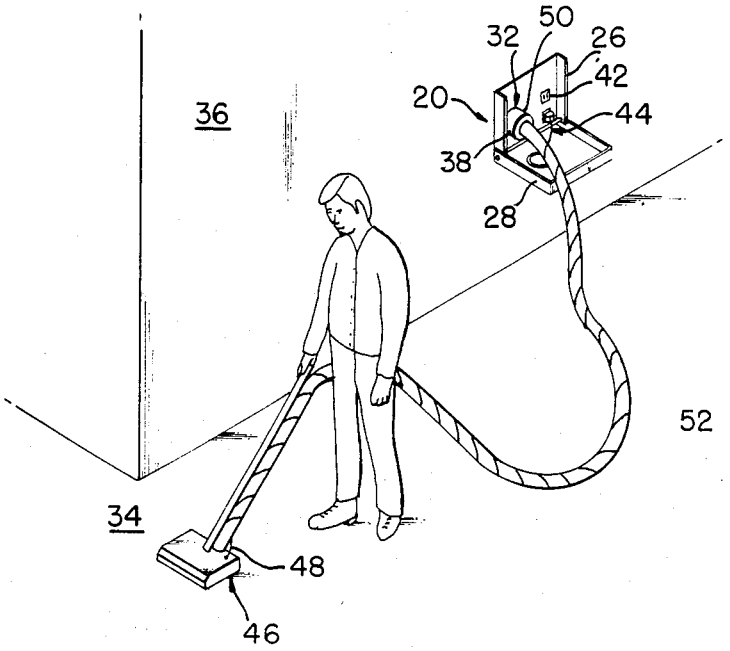

As illustrated in FIG. 1, the wall or floor outlet assembly 20 mounted in a wall 36 of a dwelling 34 makes the built in vacuum system 32 available for use by opening the cover 28 to gain access to the vacuum valve 38, the 24 volt overall control circuitry 40, and the receptacle 42 of the 110 to 115 volt overall power circuitry 44. If the person cleaning uses an electrically powered rotating brush or beater bar unit 46 to loosen dirt for vacuuming, the power cord 48 of such a unit is conveniently plugged into the outlets 41 of the receptacle 42 adjacent to the vacuum valve 38, where the end 50 of the portable vacuum conduit or hose 52 is sealably inserted. Moreover, the receptacle 42 is available at other times for receiving electrical plugs of other electrical equipment, when the built in vacuum system 32 is not being operated.

The mounting bracket 22 of the wall or floor outlet assembly 20, is illustrated in FIG. 2, with phantom lines indicating how this mounting bracket 22 may be secured to a stud 54 of a dwelling 34 by using fasteners 56. Preferably the mounting bracket 22 is integrally made to provide an electrical box 58 with a receiving chamber 60, and an adjacent receiving and mounting plate 62.

The electrical box 58 has: knockouts 64 selectively used to clear the way for electrical wires; mounting tabs 66 with holes 68 to receive fasteners 69 to be used to secure a receptacle 42, preferably sized to receive two electrical plugs of a 110 to 115 volt circuit; and a flange 70 to receive fasteners 56 used in securing the mounting bracket 22 to the dwelling 34 and/or in securing the combination 24 of the frame 26 and cover 28.

The adjacent integral receiving and mounting plate 62 commences at the electrical box 58 and extends as a rectangular plate until terminating in an offset integral portion 72 having holes 73, which receives flush head fasteners 56 securing the mounting bracket 22 to a stud 54 of a dwelling 34, and fasteners 84 securing the combination 24 of the frame 26 and cover 28. In the central area of this receiving and mounting plate 62, an opening 74 is made to receive the vacuum valve components of the built in vacuum system 32. Adjacent the opening 74 is an area which receives a sealing gasket 76. Other knockouts or holes are provided as needed, such as hole 78 to receive electrical components providing a power available indicating light 77, observable through lens 79.

The combination 24 of the frame 26 and cover 28, illustrated in FIG. 4, includes spring hinges 80 and hinge pin 81, to keep the cover closed. The frame 26 has holes 82 to receive fasteners 84 which are used to secure the combination 24 of the frame 26 and cover 28, to the mounting bracket 22. The inside of the cover 28 has a sealing gasket 86, held in place by fastener 88, to seal the vacuum valve components installed at the opening 74 in the receiving and mounting plate 62, and around the vacuum hose opening 102. The back panel 90 of the frame 26 has thus hole 102 serving as the vacuum hose opening 102, to match the hole 74 in the receiving and mounting plate to accommodate the vacuum valve components. Also the back panel 90 has alike openings 92 to clear the access for electrical plugs being inserted into the outlets 41 of the receptacle 42. The mounting bracket 22, as shown in FIG. 8, receives the attachment adapter 23, via holes 105 and fasteners 106, is in turn later receive vacuum conduit 98. Other holes are provided as necessary, to accommodate accessories made by different manufacturers.

These components comprising essentially the mounting bracket 22 and the combination 24 of the frame 26 and cover 28, serve as the basic embodiment of the wall or floor outlet assembly 20, which is provided to receive both built in vacuum cleaning conduits 98 and the portable vacuum hoses 52 and their low voltage power circuitry 40, and the high voltage electrical power cords and wires of the 110–115 volt circuitry 44.

Other electrical and vacuum components may be secured to these components at the time of manufacturer, such as the vacuum valve components 94 and the 24 volt circuitry switching components 96, as illustrated in FIG. 6. Also shown in FIG. 6 are other components secured to the overall system such as the overall control low voltage circuit 40 and the overall vacuum conduits 98.

As shown in FIG. 7, a conventional receptacle 42 is installed in the electrical box 58 of the mounting bracket 22. This receptacle 42 in turn is connected to an overall 110 to 115 volt electrical circut 44.

Spaced lock posts 100 located below the vacuum hose opening 102 serve to confine a projection, not shown, on the inserted handle portion of the portable vacuum hose or conduit 52, to keep it from rotating after its insertion during the cleaning operations. Hole 103 and fastener 104 serve to hold the back panel 90 to the receptacle 42. Slotted holes 89 are used in the plastic guard 30 to receive temporary fasteners which are used to hold the plastic guard temporarily in place.

By placing these wall or floor outlet assemblies 20 in a dwelling 34, the persons operaing the vacuum cleaning equipment are able to do a better job faster. There is no searching for 110 to 115 volt outlets and/or for extension cords, when electrically driven power brushes or beater bars are to be used to dislodge dirt for its immediate vacuuming. At other times 110 to 115 volt electrical power is always available.

I claim:

1. A wall or floor outlet assembly to be used in conjunction with a built in vacuum system using a 24 volt control circuit and requiring 110 to 115 volt power circuit when electrically driven rotary units are operated to dislodge dirt during the vacuuming operations, comprising:

(a) a mounting bracket, having:

(1) an electrical box with a receiving chamber to receive a receptacle having a 110 to 115 volt outlet; and (2) an adjacent secured receiving and mounting plate with respective receiving places to receive portions of a vacuum conduit and portions of a 24 volt circuit; and (b) a combined frame and spring retracted cover for attachment to the mounting bracket to cover and to seal portions of the various vacuum and electrical components to be secured to the receiving and mounting plate, and to provide an overall decorative full cover.

2. A wall or floor outlet assembly as claimed in claim 1, comprising, in addition, a plaster guard for initially and temporarily fitting over the receiving and mounting plate and receiving chamber of the mounting bracket to keep them clean during follow on construction work.

3. A wall or floor outlet assembly, as claimed in claim 1, having vacuum conduit components secured to the receiving and mounting plate to provide the basis for a vacuum valve.

4. A wall or floor outlet assembly, as claimed in claim 3, having 24 volt electrical circuit components secured to the receiving and mounting plate to provide the basis for closing the 24 volt control circuit, to in turn trigger the operation of a 110 to 115 volt circuit arranged to supply power to an electrical motor driving a fan of the central built in vacuum system.

5. A wall or floor outlet assembly, as claimed in claim 4, having 110 to 115 volt electrical circuit components secured to the electrical box having the receiving chamber, to provide electrical outlets for plugging in electrical equipment requiring 110 to 115 volt electrical power.

6. A wall or floor outlet assembly, as claimed in claim 1, wherein the mounting bracket is made to integrally include the electrical box and the adjacent receiving and mounting plate.

* * * * *